United States Patent [19]

Martin

[11] 4,344,378

[45] Aug. 17, 1982

[54] PORTABLE CLEAT FOR MARINE USE

[76] Inventor: Edson J. Martin, Box 309, Canton, N.Y. 13617

[21] Appl. No.: 144,420

[22] Filed: Apr. 28, 1980

[51] Int. Cl.[3] ..... B63B 21/04

[52] U.S. Cl. ..... 114/218

[58] Field of Search ..... 403/303, 312, 300, 406, 403/407, 313; 114/221 R, 230, 218

[56] References Cited

U.S. PATENT DOCUMENTS

| | | | |
|---|---|---|---|
| 1,328,985 | 1/1920 | Cook et al. | 114/218 |
| 2,469,443 | 5/1945 | Reiter | 114/218 |
| 3,559,250 | 2/1971 | Huggins | 114/218 |
| 3,703,875 | 11/1972 | Gunualson | 114/230 |
| 4,105,351 | 8/1978 | Anderson | 403/312 |

*Primary Examiner*—Trygve M. Blix
*Assistant Examiner*—Thomas J. Brahan
*Attorney, Agent, or Firm*—Bruns & Jenney

[57] ABSTRACT

A portable cleat for securing the mooring lines of a boat to a plank dock or pier when permanent cleats or other line securing means are not available. It is contemplated that two or more of the portable cleats will be carried by a cruising boat and when needed the cleats can be temporarily mounted on the dock to enable the boat to be moored alongside. Each portable cleat includes a narrow, elongated bar or plate that can be passed down through the space between adjacent planks and then rotated 90° so as to be transversely disposed with respect to the length of the planks. A threaded rod is fixed to the transverse plate and projects up between the planks and a cleat element is releasably connected to this rod, the cleat element engaging the upper side of the dock planking so that a mooring line or lines can be secured thereto.

2 Claims, 3 Drawing Figures

PORTABLE CLEAT FOR MARINE USE

BACKGROUND OF THE INVENTION

This invention relates generally to boating equipment, and has particular reference to a novel portable cleat for securing the mooring lines of a boat to a dock when permanent cleats or other line securing means are not available.

With the ever increasing popularity of pleasure boating, it frequently happens that a boat wishing to make a mooring alongside a dock or pier will find that all of the permanent cleats, rings or the like are already in use and there is nothing to which even one more line can be secured. When this happens, it becomes necessary to tie up to another boat or move to a less crowded location, neither of which may be a desirable solution to the problem. A more desirable solution is to provide a portable cleat or the like which can be carried on the boat and releasably secured to the dock when needed.

Portable cleats have been developed heretofore, and two such cleats are disclosed in U.S. Pat. No. 1,328,985, issued Jan. 27, 1920 to C. D. Cook et al and U.S. Pat. No. 2,469,433 issued May 10, 1949 to L. Reiter. Of these, the Cook et al patent is the closest prior art known to the applicant. The Cook et al and Reiter patents differ from the present invention in that they both employ a C-clamp type device for securing the cleat in position for use. A C-clamp securing means has the disadvantage that it can only be secured to the edge of the dock or the like, and the further disadvantage that it is limited as to the thickness of the members to which it can be secured.

Two additional patents developed in a preliminary search and relating to cleat type devices are U.S. Pat. No. 107,738, issued Sept. 27, 1870 to J. T. Thomson and U.S. Pat. No. 2,602,618, issued July 8, 1952 to J. Cohen.

SUMMARY OF THE INVENTION

The cleat assembly of the present invention is readily portable, can be easily stored aboard even a small pleasure boat and can be quickly mounted on a plank dock or pier to enable the mooring lines of the boat to be safely secured thereto.

The cleat assembly includes a narrow, elongated bar or plate that can be passed down through the space between adjacent planks and then rotated 90° so as to be transversely disposed with respect to the length of the planks. Projecting upwardly from the bar at substantially right angles thereto is a threaded rod that extends up through the space between the planks, the rod being long enough so that it extends above the upper surfaces of even relatively thick planks. The upwardly projecting rod passes through the central bore of a cleat element that engages the upper surfaces of the planks, and a wing nut on the rod above the cleat element is tightened down to force the cleat into tight engagement with the dock planking.

DESCRIPTION OF THE PREFERRED EMBODIMENT

Figure 2:
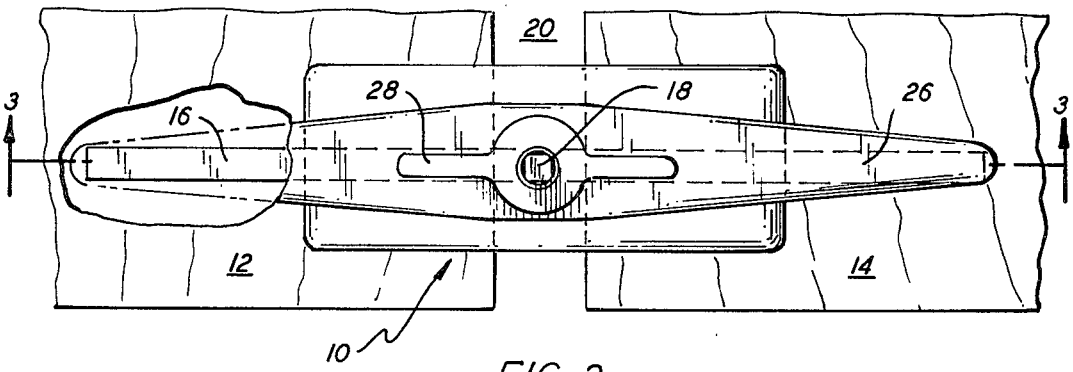
FIG. 2 is a top plan view of the cleat assembly of FIG. 1 with a portion broken away to better illustrate the construction.

Having reference now to the drawings, the cleat assembly, generally indicated at 10, is shown mounted on a plank dock, the assembly engaging a pair of adjacent wood planks 12 and 14. The cleat assembly 10 includes an elongated, relatively narrow bottom plate or bar 16 adapted to engage the underside of the dock planks. One end of a rod member 18 is secured as by welding to the approximate mid-point of plate 16, and this member is adapted to extend upwardly through a space 20 between the planks 12 and 14. The rod member 18 has a square cross section as best shown in FIG. 2, and at least the upper portion thereof is threaded as indicated at 22.

Figure 1:
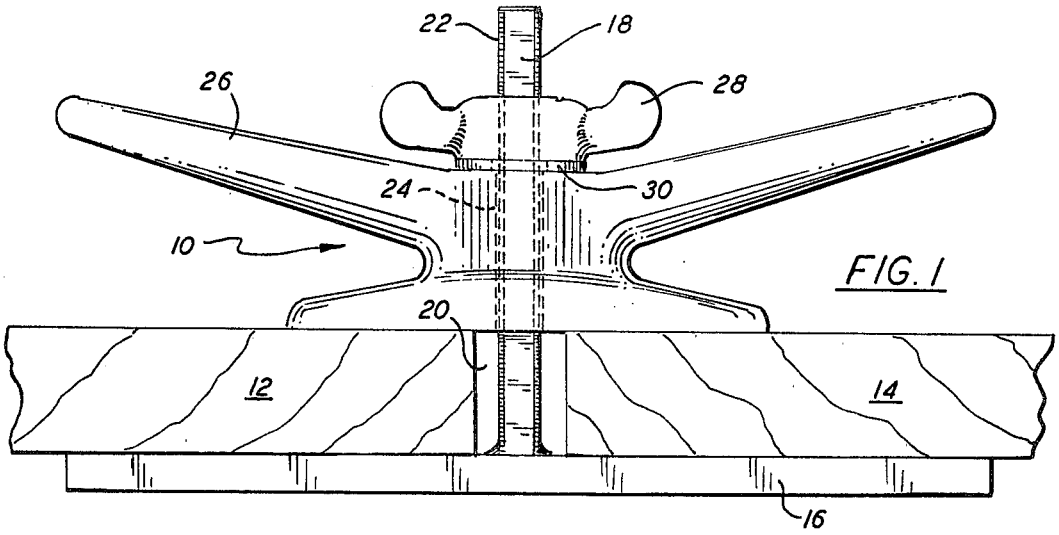
FIG. 1 is a side elevation of a cleat assembly embodying the invention, the assembly being shown mounted on a plank dock.
Figure 3:
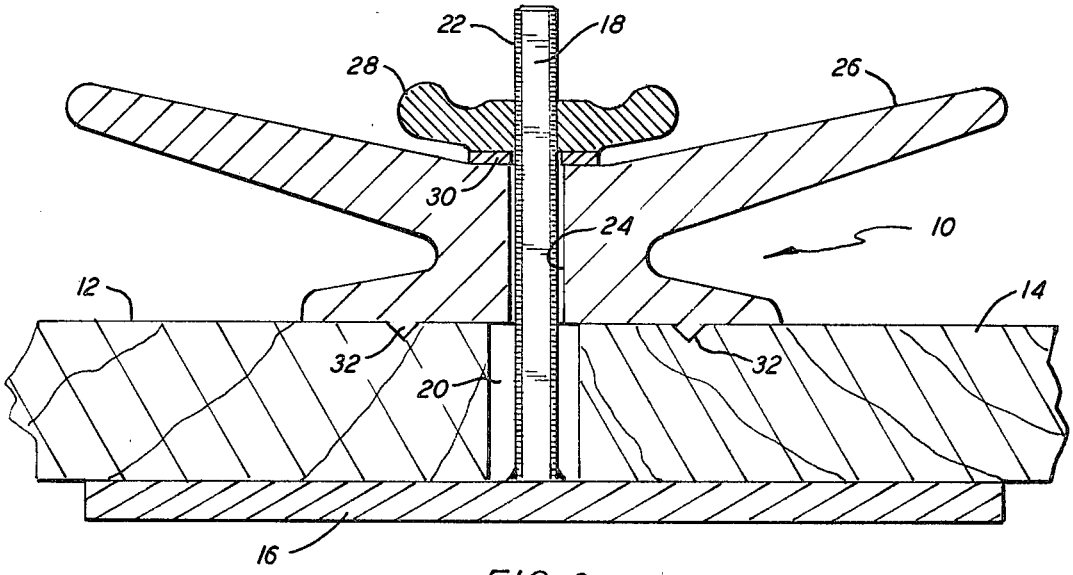
FIG. 3 is a longitudinal vertical section through the cleat assembly taken on line 3—3 of FIG. 2.

The rod member 18 is long enough to extend well above the upper surfaces of even relatively thick planks, FIGS. 1 and 3. Above the planks, the rod member passes with a free fit through a vertical, central bore 24 in a cleat element 26 of substantially conventional configuration. A securing member such as a wing nut 28 or the like is threaded on the rod member above the cleat element, and a suitable washer 30 is positioned between the wing nut and cleat as shown.

As noted above, it is contemplated that two or more of the cleat assemblies 10 will be carried on a cruising boat and when needed each cleat will be mounted on the dock in the following manner. With the plate 16 in lengthwise alignment with the space 20 between the planks and the user holding the upper end of the rod 18, the plate is passed down between the planks. When the plate is below the planks, it is rotated approximately 90° so that it bridges the space and is disposed transversely with respect to the length of the planks as shown in FIGS. 1 and 3.

After the plate 16 has been positioned as just described, the wing nut 28 is tightened down to force the cleat element 26 and plate 16 into secure engagement with the upper and lower sides of the planks respectively. In this connection, it should be noted that the wing nut 28, washer 30 and cleat element are normally already mounted on the rod 18 when the plate 16 is passed down between the planks and rotated.

To eliminate any possibility of the cleat element rotating after being mounted on the dock, it may be provided with spurs 32, FIG. 3, that are forced into the wood planks when wing nut 28 is tightened.

From the foregoing description it will be apparent that the invention provides a novel portable cleat assembly that can be conveniently carried in a boat, and quickly and easily mounted on and removed from a plank dock or pier. As will be understood by those familiar with the art, the invention may be embodied in other specific forms without departing from the spirit or essential characteristics thereof.

We claim:

1. A portable cleat assembly for boat mooring lines, the cleat assembly being adapted to be temporarily mounted on a dock or pier comprised of a plurality of spaced apart planks, the cleat assembly comprising in combination an elongated, relatively narrow bottom plate adapted to be passed downwardly between a pair of adjacent planks for engagement with the underside of the planks, the plate when so engaged being transversely disposed with respect to the length of the planks, a rod member rigidly secured at one end to the approximate mid-point of the bottom plate so as to project upwardly therefrom in substantially perpendicular relation thereto, the rod member having a square cross section with at least the upper portion thereof being threaded, the rod member being arranged to extend upwardly between adjacent planks and project above the upper sides thereof, a cleat element engageable with the upper side of the dock planking, the cleat element having a central bore for receiving the rod member, the cleat element bore having a cross section conforming to that of the rod member to prevent relative rotation therebetween, and a wing nut threaded onto the rod member above the cleat element and adapted to force the cleat element into clamping engagement with the dock planking when the nut is tightened down.

2. A cleat assembly as defined in claim 1 wherein the cleat element includes spur means on its dock engaging surface for penetrating the dock planking when the wing nut is tightened down, the spur means being operable to prevent the cleat element from rotating relative to the dock.

* * * * *